United States Patent [19]

Goldish

[11] Patent Number: 4,809,971

[45] Date of Patent: Mar. 7, 1989

[54] SIT-UP EXERCISE DEVICE

[76] Inventor: Gary D. Goldish, 5111 Golden Valley Rd., Golden Valley, Minn. 55422

[21] Appl. No.: 165,130

[22] Filed: Mar. 7, 1988

[51] Int. Cl.[4] ..... A63B 23/02

[52] U.S. Cl. ..... 272/93; 272/900

[58] Field of Search ..... 272/93, 135–142, 272/900

[56] References Cited

U.S. PATENT DOCUMENTS

| | | | |
|---|---|---|---|
| 1,905,019 | 4/1933 | Turner | 272/900 X |
| 3,524,643 | 8/1970 | Hazelitt, Sr. | 272/136 X |
| 4,182,510 | 1/1980 | Lundell | 272/900 X |
| 4,378,939 | 4/1983 | Wild | 272/900 X |
| 4,611,805 | 9/1986 | Franklin et al. | 272/136 |

FOREIGN PATENT DOCUMENTS

| | | | |
|---|---|---|---|
| 2554356 | 5/1985 | France | 272/900 |

*Primary Examiner*—Richard J. Apley
*Assistant Examiner*—Robert W. Bahr
*Attorney, Agent, or Firm*—Thomas B. Tate

[57] ABSTRACT

An exercise device for assisting a person in doing sit-ups correctly and easily. The device includes a piece of plastic which is folded to fit around and under a door, and a pair of foot rests hinged to the piece of plastic. The hinge is spring-loaded such that the foot rests are biased to a position against the piece of plastic.

1 Claim, 3 Drawing Sheets

SIT-UP EXERCISE DEVICE

SUMMARY OF THE INVENTION

Sit-ups are a good exercise for strengthening the abdominal muscles, providing they are done correctly. The best position for sit-ups is the bent-leg position, wherein the feet are flat on the floor and the knees and hips are flexed to a 90 degree angle from the floor. This position minimizes the risk of low back strain which can occur if sit-ups are done with the legs extended flat on the floor. However, many people have difficulty maintaining the proper position, particularly if they do not have a partner to hold their feet down while they are exercising.

The object of the invention is to avoid these problems by providing a device enabling a person who is exercising alone to do bent-leg sit-ups correctly and easily.

DESCRIPTION OF THE INVENTION

The base 1 is made of strong three-dimensional plastic material which has ripples formed in it so that it will not bend under pressure. The plastic base 1 has two folds in it so as to form three sections. The center section is approximately 1¾ inches wide so as to correspond to the width of an average door. One folded side is filled against either side of the door 2 by sliding the base 1 under the door 2 while the door is open. The side sections are each approximately 14 inches high. Foam padding on the inner surface of the base 1 prevents scratching of the door. The door is closed while the device is in use. The base 1 is attached to the door temporarily by this method. If permanent mounting is desired, this is accomplished by placing wood screws 3 through openings drilled into the base 1 and door 2. The door can thus be opened and closed with the device in place.

Figure 1:
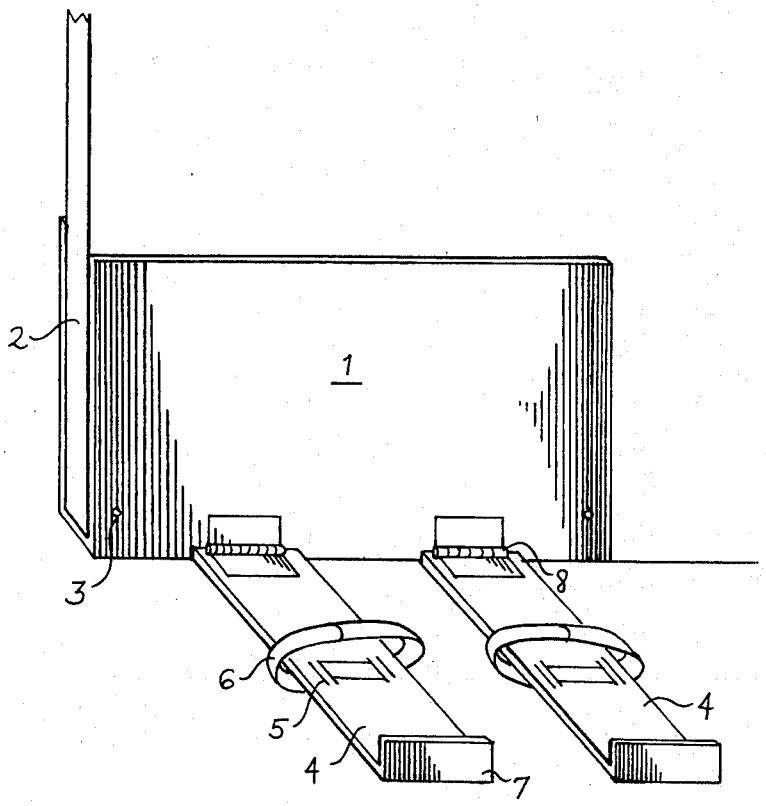
FIG. 1 is a front view of the invention in place on a door.
Figure 2:
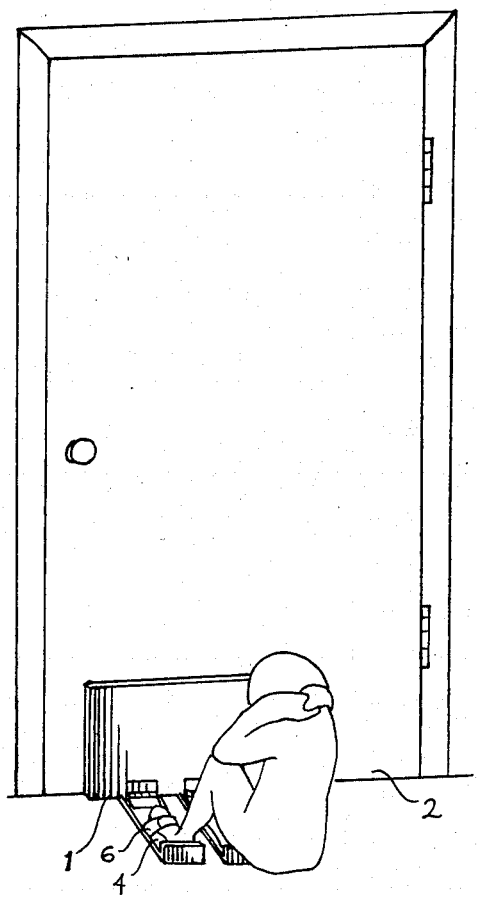
FIG. 2 shows the invention in use with the door closed.
Figure 3:
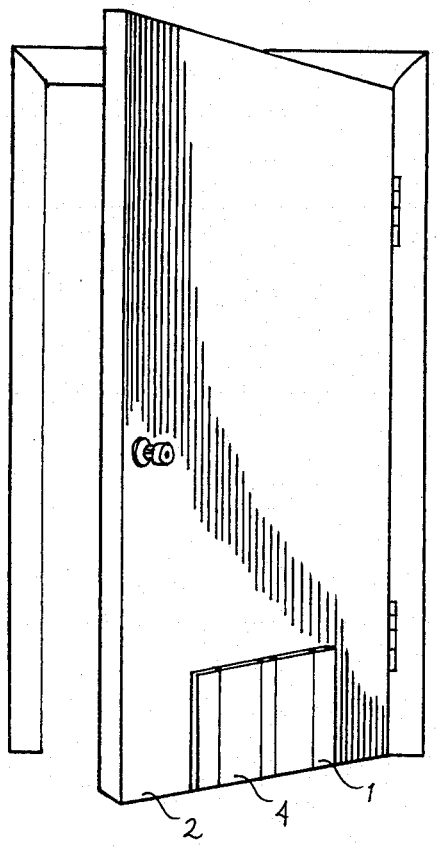
FIG. 3 shows the invention folded up against the open door when not in use.
Figure 4:
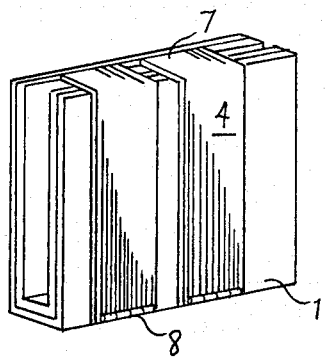
FIG. 4 shows the invention folded for storage.

Two foot rests 4, made of strong plastic, extend along the floor perpendicular to the door. The foot rests 4 are each approximately 14 inches long so as to accommodate the largest common foot size. The foot rests 4 are attached to the bottom edge of the base 1 by means of spring-loaded hinges 8 which are embedded in, or riveted to, the plastic base 1. Two slits 5 are formed into each foot rest 4 approximately half-way down its length. A VELCRO TM strap 6 is inserted through the slits 5 (fitting under the outer edges of the foot rest 4, over the foot rest 4 in the area between the slits 5, and then the two ends of the strap 6 fastening at the top of the loop) to hold the foot in place (flat on the floor) while doing sit-ups. The posterior edge of each foot rest 4 is bent up at a 90 degree angle to form a heel rest 7 which prevents the foot from sliding out of the foot rest 4. Because the foot rests 4 are attached to the base 1 by spring-loaded hinges 8, when the feet are removed, the foot rests 4 automatically fold up against the base 1. Thus the foot rests 4 are out of the way so that the door can be opened and closed when the device is not in use. The device can be stored with the foot rests 4 folded against the base 1 as shown in FIG. 4 when removed from the door (not in use). In this position, the device can be easily packed in a suitcase to be taken along while travelling.

To do sit-ups with the aid of the invention, the feet are placed flat upon the foot rests 4 and held in place by the straps 6. Because the foot rests 4 are parallel to the floor, the person using the device must place his feet flat on the floor and his knees and hips in a flexed position to a 90 degree angle from the floor. This is the correct position for sit-ups. If the legs were flat on the floor, the psoas muscle (which flexes the hip and which runs from the low back vertebrae to the femur) would be used in doing sit-ups and its pulling on the low back can cause low back strain. When the sit-ups are done in the bent-leg position, only the abdominal muscles are used in doing sit-ups. Thus the abdominal muscles are strengthened and low back strain is avoided. This is especially important for patients with low back strain who need to strengthen their abdominal muscles. Also, because the feet are held down by the device, the sacrum and coccyx do not rock up and down (which could cause pain) and the buttocks do not slide backwards during the sit-ups (thus avoiding rug burn to the buttocks).

I claim:

1. An exercise device designed to assist a person in doing sit-ups, said device comprising:

a base which is folded to form three sections which can be fitted around the bottom and the lower part of either side of a door;

a pair of foot rests attached to said base by spring-loaded hinge means, said spring biasing said foot rests into a folded position against said base, wherein said foot rests extend perpendicularly from said base and lie flat upon the floor during use and fold against said base when not in use;

said foot rests each being provided with a heel rest formed perpendicularly to the posterior end of each of said foot rests; and, each of said foot rests having a pair of slits formed in it at approximately the midpoint of its length, and having a strap disposed through said slits, each of said straps forming a loop into which a human foot can be placed in order for a person to do sit-up exercises.

* * * * *